US009211989B2

(12) United States Patent
Ahn et al.

(10) Patent No.: US 9,211,989 B2
(45) Date of Patent: Dec. 15, 2015

(54) BLISTER PACKING CONTAINER CAPABLE OF RESEALING

(75) Inventors: Jong Won Ahn, Seoul (KR); Hyung Jae Kim, Ansan-si (KR)

(73) Assignee: BLISSPACK CO., LTD., Gyeonggi-Do (KR)

( * ) Notice: Subject to any disclaimer, the term of this patent is extended or adjusted under 35 U.S.C. 154(b) by 119 days.

(21) Appl. No.: 14/111,178

(22) PCT Filed: Apr. 15, 2011

(86) PCT No.: PCT/KR2011/002697

§ 371 (c)(1),
(2), (4) Date: Oct. 11, 2013

(87) PCT Pub. No.: WO2012/141355

PCT Pub. Date: Oct. 18, 2012

(65) Prior Publication Data

US 2014/0027334 A1 Jan. 30, 2014

(51) Int. Cl.

| | |
|---|---|
| ***B65D 73/00*** | (2006.01) |
| ***B65D 75/36*** | (2006.01) |
| ***B65D 75/32*** | (2006.01) |
| ***B65D 75/58*** | (2006.01) |

(52) U.S. Cl.

CPC ..... *B65D 75/366* (2013.01); *B65D 75/326* (2013.01); *B65D 75/5855* (2013.01); *B65D 2221/00* (2013.01); *B65D 2575/3245* (2013.01)

(58) Field of Classification Search

CPC ..... B65D 75/366; B65D 75/5811; B65D 75/367; B65D 2575/586; B65D 75/30; B65D 75/58; B65D 77/2072

USPC ..... 206/469–470, 484, 461, 530, 528, 206/534.1, 534.2, 466, 467; 215/47; 222/153.06, 541.9, 212, 107, 494

See application file for complete search history.

(56) References Cited

U.S. PATENT DOCUMENTS

| | | | | | |
|---|---|---|---|---|---|
| 3,184,149 | A | * | 5/1965 | Repko | 383/203 |
| 3,278,085 | A | * | 10/1966 | Brown | 222/107 |
| 3,815,810 | A | * | 6/1974 | Wellman | 383/204 |
| 3,013,734 | A | | 10/1975 | Siegel | |
| 4,209,096 | A | * | 6/1980 | Carkhuff | 206/469 |
| 5,228,782 | A | * | 7/1993 | Imer | 383/200 |
| 5,518,790 | A | * | 5/1996 | Huber et al. | 428/35.2 |
| 5,826,737 | A | * | 10/1998 | Zakensberg | 215/47 |
| 6,131,737 | A | | 10/2000 | Marshall | |

FOREIGN PATENT DOCUMENTS

KR 20-0396262 Y1 9/2005

* cited by examiner

*Primary Examiner* — Chun Cheung

(74) *Attorney, Agent, or Firm* — Revolution IP, PLLC

(57) ABSTRACT

Provided is a blister package made by heat molding a plastic film or sheet, creating a container portion of a fixed space, storing a drug or miscellaneous products in the space, and having a cover sheet attached to a flange of the container portion so as to create a sealing function, and the blister packing container enables repeated resealing and enhanced sealing of an opened outlet.

6 Claims, 5 Drawing Sheets

BLISTER PACKING CONTAINER CAPABLE OF RESEALING

CROSS REFERENCE TO PRIOR APPLICATIONS

This application is a National Stage Application of PCT International Patent Application No. PCT/KR2011/002697 filed on Apr. 15, 2011, under 35 U.S.C. §371, which is hereby incorporated by reference in its entirety.

TECHNICAL FIELD

The present invention relates to a blister package made by heat molding a plastic film or sheet, creating a container portion of a fixed space, storing a drug or miscellaneous products in the space, and having a cover sheet attached to a flange of the container portion so as to create a sealing function, the blister packing container enabling repeated resealing and enhanced sealing of an opened outlet, and more particularly, to a blister package which may extend an upper flange of the container portion and include a collapsible sealing piece with a collapsible guiding groove formed in the upper flange so that the outlet is sealed and blocked by collapsing the collapsible sealing piece after the use of content, include a latched peripheral portion and a latching piece with a latching protrusion selectively latched on the latched peripheral portion formed on both sides of the flange of the container portion and the collapsible sealing piece so that the collapsible sealing piece may be locked so as to be kept collapsed as necessary, include a cutout portion extending inward to a predetermined depth formed in a bottom connection portion of the collapsible sealing piece and the latching piece so that an elastic deformation force of the latching piece against bending may be improved to induce a reduction in external force of the latching protrusion at the time of locking, smoothness of an operation of the latching protrusion, and initial cutout of a cover paper, and include a ring portion with a latched hole formed above the collapsible sealing piece so that it is possible to provide convenience in display or storage of the container.

BACKGROUND ART

Typically, a blister package is one packing method as a thermoplastic plastic film or sheet, and is a method performed in such a manner that a mold manufactured in accordance with a shape of a product desired to be packed is installed in a molder, a content or product is put in a swelled portion of a plastic film or sheet formed by pressure forming or vacuum forming, and then only a flat part (flange portion) of the molded film or sheet is heat-sealed or attached, which is widely used in packaging of food, daily necessities, goods, refined chemicals, cosmetics, and the like.

Meanwhile, a liquid, creamy, or waxy content such as food including various sauces, cosmetics, and the like may also be packed using the blister package, and the blister package applied to this may be configured in such a manner that an eluted side end portion of a container with an arbitrary shape is made of the same material as the container in the manufacturing process, an outlet in the form of a single pipe for discharging a content by opening an inside of the outlet, as necessary, is maintained to be communicated, and a multi-layered cover paper for sealing is attached in an opening and the flange of the container so that the opening of the container is covered and sealed while a soft portion of the container is formed of a flat flange.

However, as to the blister package having such a basic configuration, there are two structures such as the conventional structure for discharging the content in which a perforated line connected up to both ends of the flange is formed while laterally traversing a discharge portion of the molded plastic film or sheet and the discharge portion is cut by breaking the discharge portion with respect to the perforated line when discharging the content so that the opening is opened to withdraw the content, and a structure in which an adhesive portion enabling the cover paper attached to the flange of the container to be attached to the flange to perform a sealing function and a non-adhesive portion preventing the cover paper from being attached to the flange to separate the cover paper from the flange so as to facilitate grasping when separating and removing the adhesive portion and the cover paper from each other are provided while giving a perforated line so that a cut part of the adhesive portion penetrates the discharge portion in a straight line.

Meanwhile, an amount of the content received in the container may be all consumed in a disposable manner, but an amount to be used multiple times may be received in the container in most cases, and therefore there is a demand for a structure in which the opening is sealed after the use even after opening the discharge portion.

However, in an existing opening structure of such a discharge portion, the semicircular discharge portion is completely opened when tearing-off the cover paper contacting the discharge portion through the perforated line so that discharge of the content is smoothly performed but the opened opening cannot be selectively blocked, and therefore a separate plug or the like should be provided to block the opened opening. In addition, in the existing opening structure, when the opening is not sealed, external air or foreign substances may be introduced into the container through the opening and cause spoilage of the content such as discoloration or a bad flavor, or the content may be hardened and cause a great reduction in the service life and side effects, and therefore reliability of the quality may be reduced.

In addition, the content is highly likely to be leaked through the opened opening, a periphery of the discharge portion may be contaminated and defile the appearance of the container, and inconvenience such as having to stand the container up straight may be caused.

In order to solve the above-described problems, there has been known a structure for improving a sealing property of an opened outlet, which is disclosed in registration number 20-0316761 of earlier filing of the present applicant. In such a structure for improving the sealing property, when attaching a cover paper attached to a flange of a container to perform a sealing function on an adhesive portion so that a non-adhesive portion for separating the cover paper from the adhesive portion is provided, a discharging non-adhesive portion which has a predetermined area may be artificially provided while communicating with the discharge portion of the container within the adhesive portion of the cover paper, and at the same time a perforated line which is perpendicular to a longitudinal direction of the container and whose cut part penetrates the discharging non-adhesive portion in a straight line may be formed in the non-adhesive portion, so that an opening through which the content can be discharged may be provided on a flat flange. Thus, the discharging non-adhesive portion may be forcedly opened in accordance with pressing and releasing of the container to discharge the content, or may be tightly pulled to its original state to maintain a plane while being brought into close contact on the flange so that the opening may be automatically closed, thereby improving sealing properties of the content.

However, in the above-described invention of the earlier filing of the present applicant, there is room for improvement due to the following problems.

First, the outlet opened by tearing-off the non-adhesive portion separated from the flange in order to withdraw the content may be sealed by tightly pulling the discharging non-adhesive portion by an elastic return force of the container itself after withdrawing a desired amount of the content. However, residues of the discharged content are coated around an entrance of the outlet as is and exposed to the outside, which defiles the appearance of the container, and the exposed content is highly likely to be hardened and acidified, and therefore inconvenience such as having to remove the content near the entrance one by one when using the container later may be caused, and the exposed and contaminated content may be unsanitary because it is highly likely to contaminate the remaining entire contents of the inside of the container.

Second, the entrance of the outlet which is sealed only through an elastic return force may be slightly opened because the outlet is difficult to completely and tightly seal due to the residual content near the entrance of the outlet, and therefore it is difficult to prevent the content from being leaked when a separate external force is applied to the container such as movement or possession of the container. As a result, there is an urgent demand for a reinforced sealing structure for additionally sealing the outlet.

DISCLOSURE

Technical Problem

The present invention is directed to providing a sealing structure of an outlet of a blister packing container which may collapse a collapsible sealing piece after the use of a content to additionally seal and block the primarily sealed outlet, thereby reinforcing a sealing force of the outlet and covering a content around the outlet to maintain a clean appearance of the container.

The present invention is also directed to providing a sealing structure of an outlet of a blister packing container in which a latching piece may be selectively locked through a latched peripheral portion so that a collapsible sealing piece may be kept collapsed, thereby completely preventing leakage of the content even when an external force in accordance with possession and the like of the container is applied.

The present invention is also directed to providing a sealing structure of an outlet of a blister packing container which may induce a reduction in an external force toward a latching protrusion, smoothness of the operation, and initial cutout of a cover paper at the time of locking through a cutout portion.

Technical Solution

One aspect of the present invention provides a blister packing container which may extend an upper flange of a container portion and include a collapsible sealing piece having a collapsible guiding groove.

Another aspect of the present invention provides a blister packing container which may include a latched peripheral portion and a latching piece having a latching protrusion selectively latched on the latched peripheral portion respectively on both sides of a flange of a container portion and a collapsible sealing piece.

Still another aspect of the present invention provides a blister packing container which may include a cutout portion inward extending in a predetermined depth formed in a bottom connection portion of the collapsible sealing piece and the latching piece, thereby giving elastic flexibility against bending to the latching piece.

Advantageous Effects

As described above, according to the present invention, in the case of a pouch (sachet) or blister package which is widely used in packaging of a small amount of food, drug, and cosmetics, the package is impossible to seal again once it is used in a disposable manner so that most of the blister package should be discarded, but the blister package capable of resealing may be used several times, thereby improving ease of use and reducing an environmental load.

Also, an outlet which is opened after the use of content may be additionally sealed and covered through a collapsible sealing piece, and therefore a sealing force of the outlet may be reinforced and the content around the outlet may be covered to maintain a clean appearance.

Also, a latched peripheral portion and a latching protrusion which is selectively latched on the latched peripheral portion may be provided respectively in both sides of a flange of a container portion and a collapsible sealing piece, and therefore the collapsible sealing piece may be kept collapsed, thereby completely preventing leakage of the content even when an external force in accordance with possession and the like of a container is applied.

Furthermore, elastic deformation of a latching piece may be smoothed through a cutout portion to smooth deformation such as bending of the latching piece at the time of locking operation, and therefore a locking operation of the latching piece may be rapidly or simply performed, an external force applied to a latching protrusion may be reduced at the time of locking or unlocking to improve durability of the corresponding portion, and cutout of a cover paper may be smoothly and uniformly carried out through a function of setting an initial cutout position of the cover paper for opening an outlet.

MODES OF THE INVENTION

Figure 1:
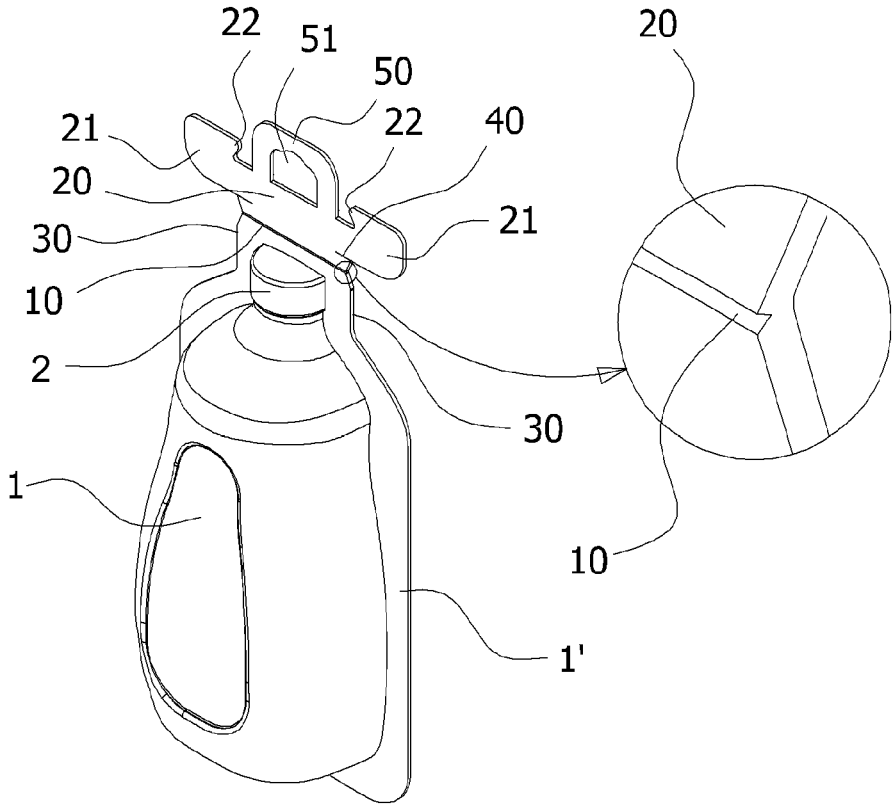
FIG. 1 is a perspective view showing a configuration example of a container according to an embodiment of the present invention.
Figure 2:
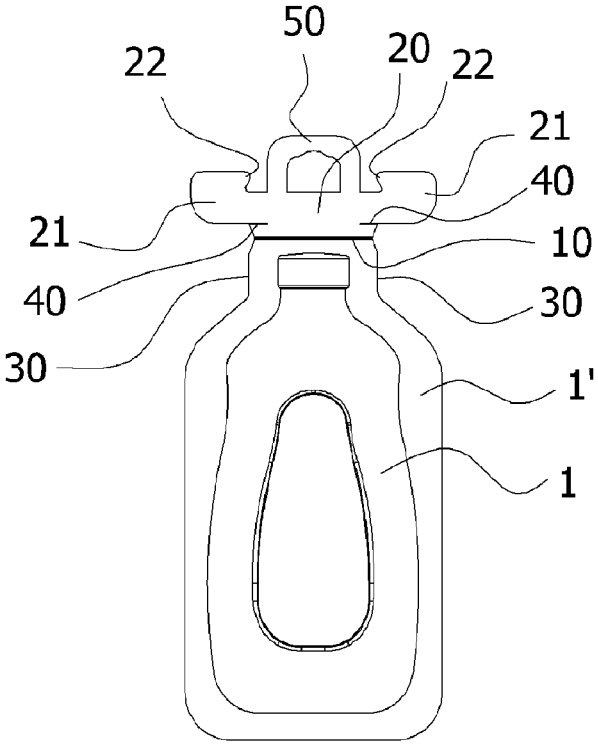
FIG. 2 is a front view showing a container according to an embodiment of the present invention.

FIG. 1 is a perspective view showing a configuration example of a container according to an embodiment of the present invention.

Hereinafter, a configuration of the present invention will be described in detail with reference to the accompanying drawings.

According to the present invention, there is provided a blister packing container capable of resealing in a known structure in which a discharge portion 2 in the form of a single pipe is provided in an upper end of an eluted container portion 1 with an arbitrary shape, an adhesive portion 3' attached to a flange 1' to perform a sealing function is provided in a cover paper 3 attached to the flange 1' of the container portion 1, a non-adhesive portion 3" configured in a non-adhesive state in order to facilitate grasping when separating and removing the cover paper 3 is provided in the cover paper, and a discharging non-adhesive portion 4 with a predetermined area is provided in the cover paper while being communicated with the discharge portion 2 of the container portion 1. Here, the blister packing container includes a collapsible guiding groove 10 configured to be laterally recessed on the flange 1' so as to be close to an upper end of the discharge portion 2 and set a bending line, and reduce resistance when a collapsible sealing piece 20 which will be described later is collapsed; the collapsible sealing piece 20 configured to be formed above the collapsible guiding groove 10; a set of latching pieces 21 configured to protrude from both ends of the collapsible sealing piece 20 and include a latching protrusion formed in an inner upper end thereof; a set of latched peripheral portions 30 configured to be formed in a soft portion of the flange 1' so as to be located on lower sides of both ends of the collapsible guiding groove 10 so that the latching protrusion 22 is selectively latched and supported; a cutout portion 40 configured to be cut out inward from the collapsible sealing piece 20 in a lower peripheral portion of the latching piece 21 and give an elastic deformation force against bending to the latching piece 21; and a ring piece 50 configured to integrally extend in an upper portion of the collapsible sealing piece 20 and include a latching hole 51.

Hereinafter, the action of the present invention configured as above will be described in detail.

Figure 3:
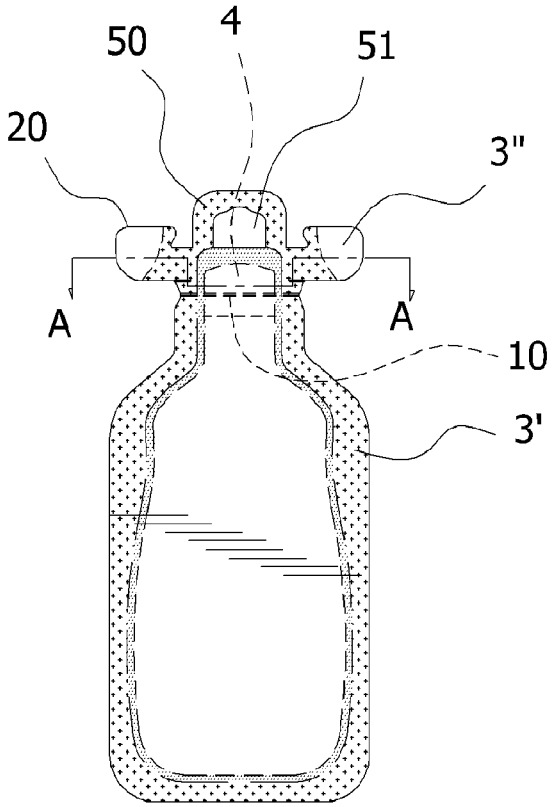
FIG. 3 is a rear view showing a container according to an embodiment of the present invention.

In the container to which the present invention is applied, the discharge portion 2 of the container portion 1 may protrude so as to be connected to the discharging non-adhesive portion 4 as shown in FIG. 3, and the discharging non-adhesive portion 10 may be positioned inside the adhesive portion 3' so that the adhesive portion 3' is formed around the discharging non-adhesive portion 4, and therefore the adhesive portion 3' may completely wrap the discharging non-adhesive portion 4 when the container is not opened, thereby preventing leakage of the content.

When pulling one end of the non-adhesive portion 3" of the cover paper 3 separated from the latching piece 21 in a non-adhesive state in order to withdraw the content of the container portion 1 in this state, a cut part of the non-adhesive portion 3" may subsequently tear out the adhesive portion 3' and the discharging non-adhesive portion 4 which are connected to the collapsible sealing piece 20 while being torn out along the cutout portion 40 extending up to an inside of the collapsible sealing piece 20, and when pulling the one end of the non-adhesive portion 3" to the end, the cut part may be completely separated from the collapsible sealing piece 20.

In this state, a state in which the discharging non-adhesive portion 4 is brought into close contact on the collapsible sealing piece 20 to seal the cut outlet as shown in a solid line is maintained before pushing the container portion 1, and therefore leakage of the content may be prevented and introduction of external air and foreign substances into the container may be prevented.

Figure 4:
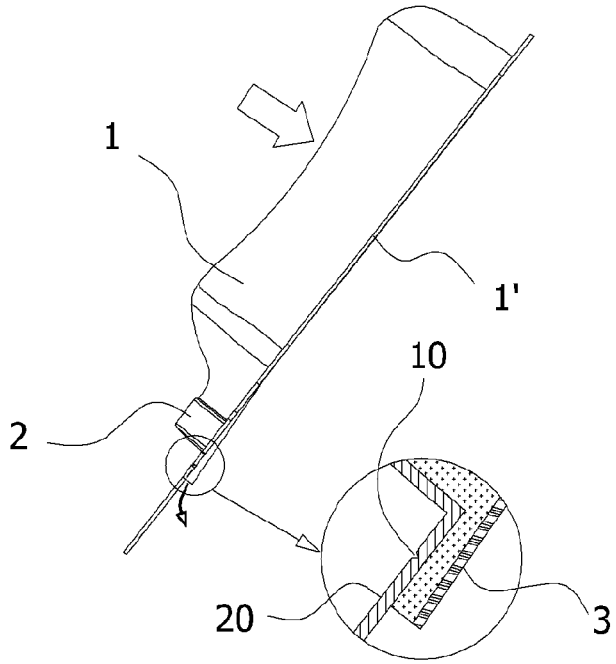
FIG. 4 is an operational state view showing a discharge state of a content of a container according to an embodiment of the present invention.

In this state, when pushing the container portion 1 as shown in FIG. 4 in order to withdraw the content, the content may be discharged in such a manner that the content forcedly pushes and opens the discharging non-adhesive portion 4 while being moved to the cut discharging non-adhesive portion 4 in accordance with contraction of the container.

Meanwhile, when a desired amount of the content is withdrawn and the pushing is released, a discharge pressure of the content may be removed and the discharging non-adhesive portion 4 may be tightly pulled by an elastic return force of the container itself, and therefore the discharging non-adhesive portion 4 may seal the opened outlet to some extent while being brought into close contact on the collapsible sealing piece 20. However, the content which cannot be discharged may remain within the discharging non-adhesive portion 4 and cause an incomplete closed state, in which case sealing cannot be properly carried out, resulting in occurrence of contact with air and foreign substances.

Figure 5:
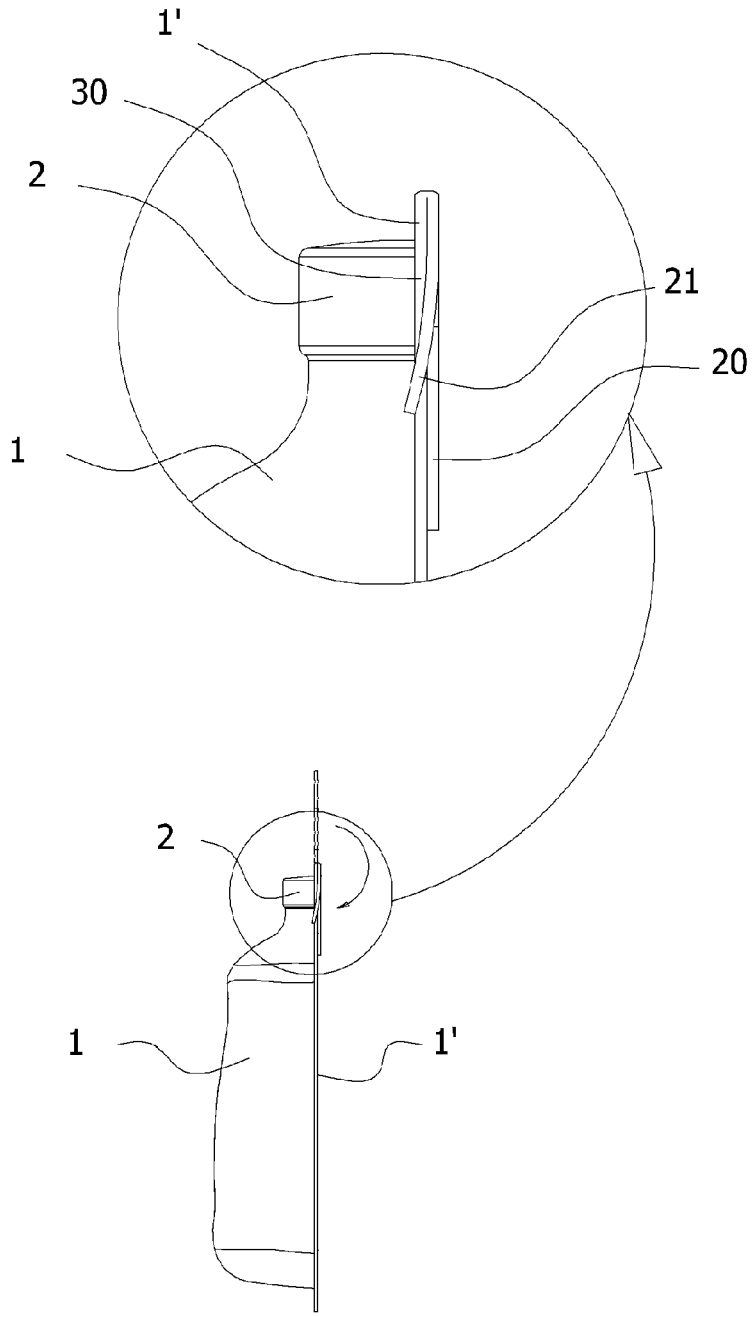
FIG. 5 is a side view showing a state in which a collapsible sealing piece which is one main portion of the present invention is collapsed.

In order to prevent such an incomplete sealing state, in the present invention, a sealing property may be additionally reinforced using the collapsible sealing piece 20 as shown in FIG. 5, which will be herein described in detail.

First, when bending the collapsible sealing piece 20 in a direction of an arrow while grasping the collapsible sealing piece 20 in which the latching piece 21 and the ring piece 50 are integrally formed, the collapsible sealing piece 20 may be bent backward to be collapsed with respect to the collapsible guiding groove 10, and therefore a middle portion of the incompletely sealed discharging non-adhesive portion 4 which is positioned in a state in which the collapsible guiding groove 10 passes across the middle portion may be bent in an opposite direction of the discharge direction, thereby sealing and blocking the outlet.

Figure 6:
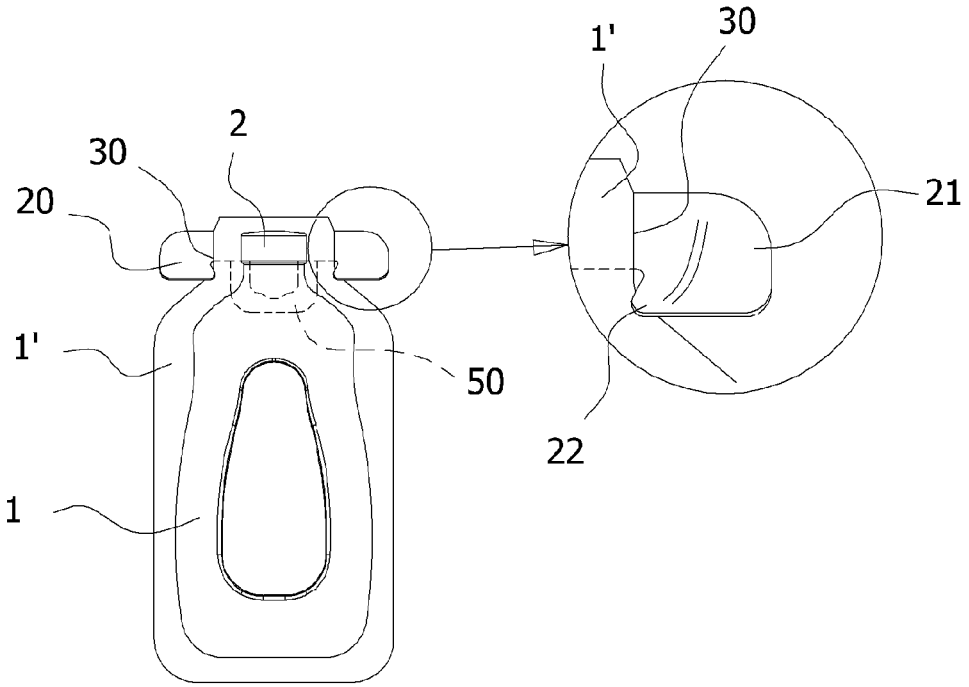
FIG. 6 is a front view showing a locked state of a latching piece which is one main portion of the present invention.
Figure 7:
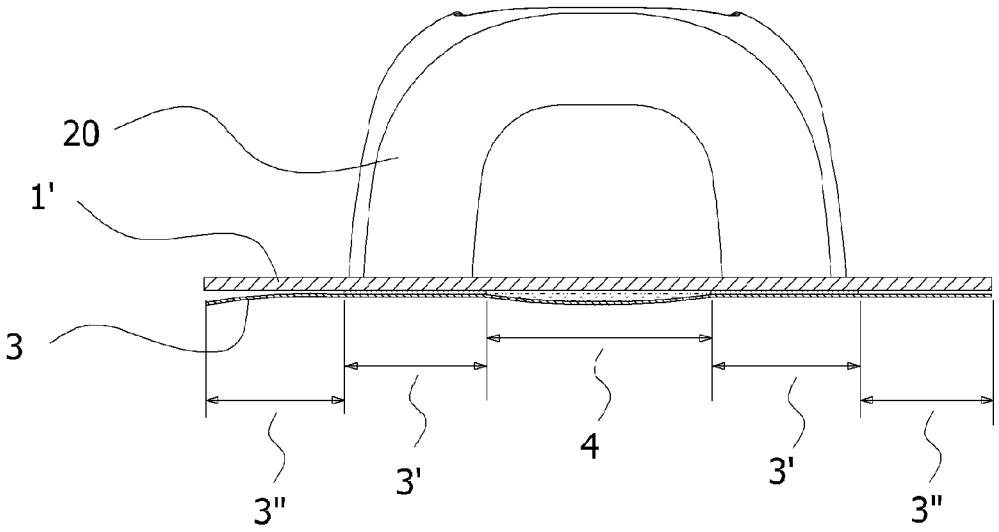
FIG. 7 is a cross-sectional view along a line A-A of FIG. 3.
Figure 8:
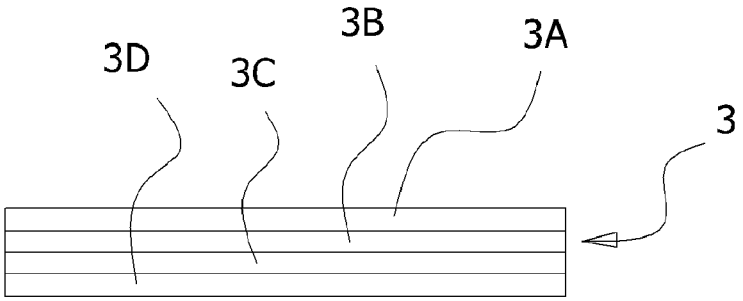
FIG. 8 is a cross-sectional view showing a configuration of a cover paper applied to the present invention.

In this manner, in a state in which the discharging non-adhesive portion 4 is completely sealed by completely bending and collapsing the collapsible sealing piece 20 and a contamination state around the outlet is completely covered to be concealed, the collapsed position should be fixed in order for the collapsible sealing piece 20 not to return to its original position to spread even in a state in which an artificial collapsing force is not applied. In this instance, when pushing the inner latching protrusion 22 toward the container portion 1 while grasping and slightly twisting both of the latching pieces 21, the entire latching piece 21 may be kept collapsed on a rear side of the flange 1' as shown in FIGS. 5 and 6, and only the latching protrusion 22 may proceed forward across the latched peripheral portion 30 to be positioned in front of the flange 1' so that a locking state is obtained in such a manner that both of the latching pieces 21 are latched on the latched peripheral portion 30, and therefore a collapsed state of the collapsible sealing piece 20 may be stably maintained before artificially releasing the collapsed state.

Figure 9:
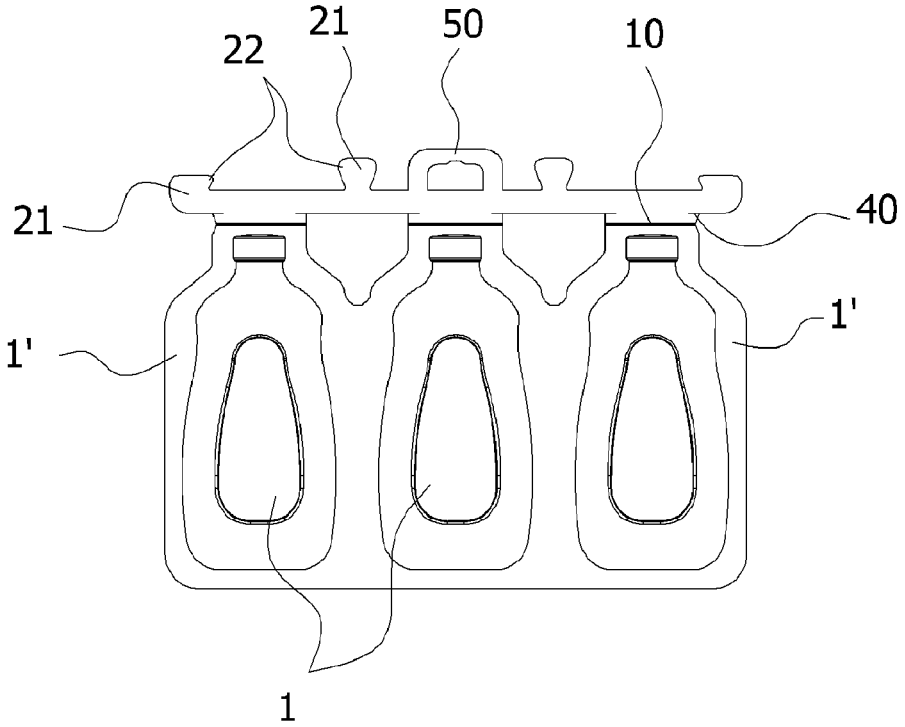
FIG. 9 is a front view showing a state in which a plurality of containers are integrally and laterally connected according to another embodiment of the present invention.
Figure 10:
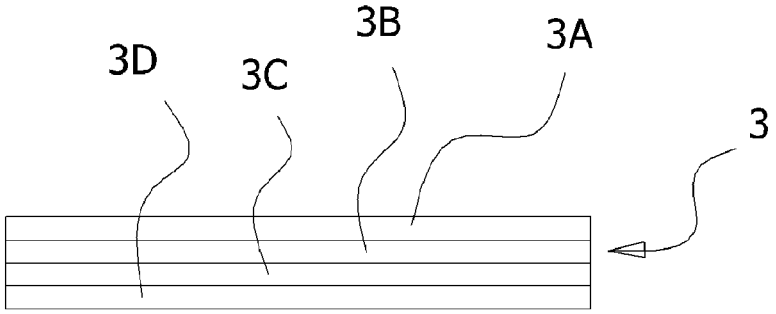
FIG. 10 is a front view showing a state in which a collapsible sealing piece is collapsed in a structure of FIG. 9.

Meanwhile, in FIGS. 9 and 10, another configuration example of the present invention is shown.

A plurality of container portions 1 for receiving heterogeneous contents may be connected as a single unit so as to be suitable for a case in which a plurality of contents are simultaneously discharged at once to be used. Here, two latched peripheral portions 30 and two latching protrusions 22 may be provided in each of the container portions 1, and obviously, the action and effects of the other configuration may be the same as in the structure of the single container portion of FIG. 1.

In the present invention, although this is not limiting, it is preferable that the cover paper 3 be obtained in such a manner that an outer layer 3A, a print layer 3B, and a mid-blocking layer 3C which are configured as a uniaxial stretch film and an inner layer 3D which is configured as a non stretched or uniaxial stretch film are stacked.

In particular, it is preferable that a material of the outer layer 3A be a uniaxial stretch film which is excellent in transparency and mechanical properties, and for example, a uniaxial stretching polyester film or a uniaxial stretching polypropylene film may be used.

It is preferable that a material of the inner layer 3D be a non stretched or uniaxial stretching film capable of heat adhering. As desirable examples, a non stretched or uniaxial stretching polyethylene film, a non stretched or uniaxial stretching polypropylene film, and the like may be given.

It is preferable that a material of the mid-blocking layer 3C be an aluminum foil having interrupting capability for protecting the content or a synthetic resin film having interrupting capability. As the desirable examples, an aluminum foil, an ethylene vinyl alcohol copolymer film, a polyacrylonitrile film, and the like may be given.

While the invention has been shown and described with reference to certain exemplary embodiments thereof, it will be understood by those skilled in the art that various changes in form and details may be made therein without departing from the spirit and scope of the invention as defined by the appended claims.

The invention claimed is:

1. A blister packing container for resealing, comprising:

a container portion (1) having an arbitrary shape;

a discharge portion (2) formed a single pipe located at an upper end of the container portion (1);

a flange (1') surrounding a perimeter of an opening of said container portion (1), said flange lying on a plane passing through the perimeter of the opening;

a cover paper (3) attached to an outer surface of the flange (1') to seal the container portion (1), the cover paper (3) including an adhesive portion (3') and a discharging non-adhesive portion (4), the discharging non-adhesive portion (4) located at an upper end of the discharge portion (2) to discharge a content from the container portion (1);

a collapsible guiding groove (10) laterally recessed on the flange (1') so as to be close to an upper end of the discharge portion (2) and setting a bending line, and reduce resistance when a collapsible sealing piece (20) is collapsed;

the collapsible sealing piece (20) formed above the collapsible guiding groove (10);

a set of latching pieces (21) protruding from both ends of the collapsible sealing piece (20) and including a latching protrusion formed in an inner upper end thereof;

a set of latched peripheral portions (30) formed in a soft portion of the flange (1') so as to be located on lower sides of both ends of the collapsible guiding groove (10) so that the latching protrusion (22) is selectively latched and supported;

a cutout portion (40) having cut out inward from the collapsible sealing piece (20) in a lower peripheral portion of the latching piece (21) and an elastic deformation force against bending to the latching piece (21); and a ring piece (50) integrally extending in an upper portion of the collapsible sealing piece (20) and including a latching hole (51).

2. The blister packing container of claim 1, wherein the collapsible guiding groove (10) is positioned in a lower portion of the cutout portion (40) so that a middle portion of the discharging non-adhesive portion (4) as a discharge path of a content is bent to be collapsed when collapsing the collapsible sealing piece (20).

3. The blister packing container of claim 1, wherein the cover paper (3) is formed with an outer layer (3A), a print layer (3B), a mid-blocking layer (3C), and an inner layer (3D) which are non stretched or uniaxial stretch films and respectively stacked.

4. The blister packing container of claim 3, wherein the outer layer (3A) is a uniaxial stretching polyester film or a uniaxial stretching polypropylene film.

5. The blister packing container of claim 3, wherein the inner layer (3D) is a non stretched or uniaxial stretching polyethylene film capable of heat adhering or a non stretched or uniaxial stretching polypropylene film capable of heat adhering.

6. The blister packing container of claim 3, wherein the mid-blocking layer (3C) is an aluminum foil, an ethylene vinyl alcohol copolymer film, or a polyacrylonitrile film.

* * * * *